US007064714B2

(12) United States Patent
Lafleur

(10) Patent No.: US 7,064,714 B2
(45) Date of Patent: Jun. 20, 2006

(54) MINIATURE CIRCULARLY POLARIZED PATCH ANTENNA

(75) Inventor: Phil Lafleur, Ontario (CA)

(73) Assignee: TransCore Link Logistics Corporation, Ontario (CA)

( * ) Notice: Subject to any disclaimer, the term of this patent is extended or adjusted under 35 U.S.C. 154(b) by 24 days.

(21) Appl. No.: 10/998,634

(22) Filed: Nov. 30, 2004

(65) Prior Publication Data

US 2005/0140552 A1 Jun. 30, 2005

Related U.S. Application Data

(60) Provisional application No. 60/532,569, filed on Dec. 29, 2003.

(51) Int. Cl.
*H01Q 1/36* (2006.01)

(52) U.S. Cl. ..... 343/700 MS; 343/770

(58) Field of Classification Search ..... 343/700 MS, 343/770, 746, 767
See application file for complete search history.

(56) References Cited

U.S. PATENT DOCUMENTS

| | | | | |
|---|---|---|---|---|
| 6,081,239 | A * | 6/2000 | Sabet et al. | 343/753 |
| 6,188,368 | B1 * | 2/2001 | Koriyama et al. | 343/767 |
| 6,429,825 | B1 * | 8/2002 | Martek | 343/770 |
| 6,452,560 | B1 * | 9/2002 | Kunysz | 343/770 |
| 6,456,241 | B1 * | 9/2002 | Rothe et al. | 343/700 MS |
| 6,940,457 | B1 * | 9/2005 | Lee et al. | 343/700 MS |
| 6,952,190 | B1 * | 10/2005 | Lynch et al. | 343/909 |
| 2005/0052321 | A1 * | 3/2005 | Lee et al. | 343/700 MS |

* cited by examiner

*Primary Examiner*—Don Wong
*Assistant Examiner*—Hung Tran Vy
(74) *Attorney, Agent, or Firm*—Blank Rome LLP

(57) ABSTRACT

A circularly polarized patch antenna for wireless communication devices is disclosed. The circularly polarized patch antenna includes a conductive ground plane positioned parallel to a multi-layer resonator with both disposed in a dielectric substrate. The multi-layer resonator may include top and middle conductive layers with meandering between layers. A plurality of slots may be interposed intermittently spanning the top and middle conductive layers. The meandering may be integrated with the slots. The circularly polarized patch antenna may be realized as a multi-layer printed circuit board.

13 Claims, 2 Drawing Sheets

(a) Multilayer Slotted Patch

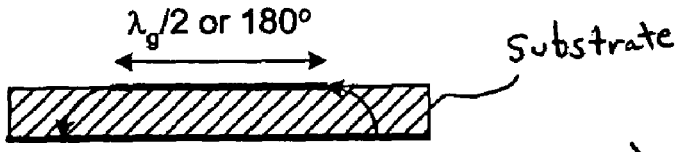
Figure 1: Patch antenna (Prior Art)
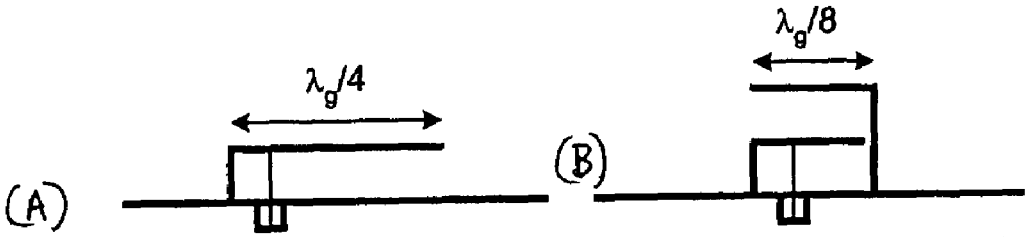
Figure 2: Short circuit patch and folded short circuit patch (Prior Art)
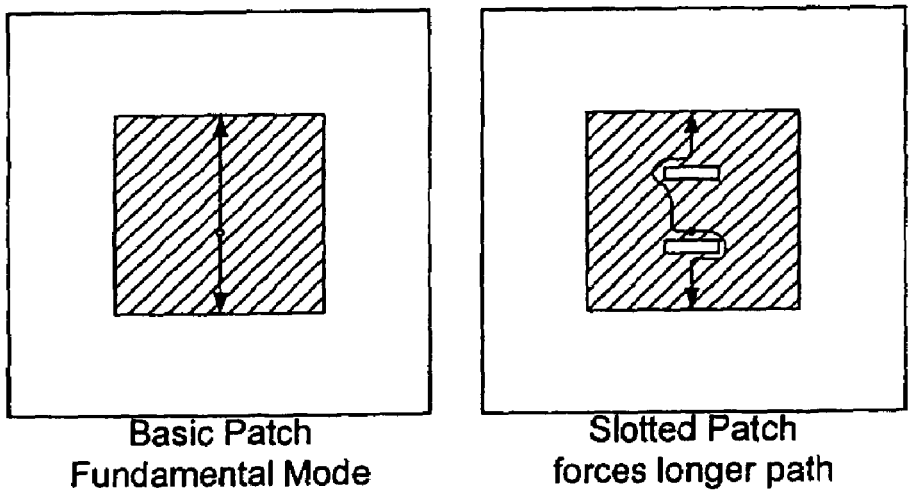
Figure 3: Basic Patch Vs. Slotted Patch (Prior Art)

(a) Multilayer Slotted Patch (b) Slotted Patch (Prior Art)

(c) Conventional Patch (Prior Art)

Top View

Top layer

Inner Layer

MINIATURE CIRCULARLY POLARIZED PATCH ANTENNA

REFERENCE TO RELATED APPLICATION

The present application claims the benefit of U.S. Provisional Application No. 60/532,569, filed Dec. 29, 2003, whose disclosure is hereby incorporated by reference in its entirety into the present disclosure.

FIELD OF THE INVENTION

The present invention is generally related to mobile communication systems and, more particularly, is related to a circularly polarized patch antenna that can be used in mobile communication systems.

BACKGROUND OF THE INVENTION

Antennas, such as used in mobile satellite communications systems, have differing requirements depending upon the particular application for the antenna. For an asset tracking application, for example, the ideal antenna would have horizon-to-horizon hemispherical coverage, have excellent circular polarization characteristics, and have a bandwidth sufficiently large to cover transmit and receive bands, while being compact and low cost.

Patch antennas may be used for applications such as GPS where circular polarization provides optimum link performance. Such antennas, although much more compact, have the disadvantage of a narrow bandwidth and are easily detuned due to their mode of operation. A reduction in antenna size is highly desirable for mobile communication systems. However, designers of antennas for systems using circular polarization (CP) have very few options, because of symmetry requirements associated with CP.

A patch antenna includes a resonant conductive patch and a conductive ground plane, both strategically disposed in a dielectric substrate. Patch antennas are approximately $\lambda_G/2$ in length, where $\lambda_G$ is the guided wavelength. The guided wavelength can be made smaller by increasing the dielectric constant of the substrate separating the patch from the ground plane. A linearly polarized patch can be visualized as two radiating edges, which radiate in-phase because of the 180 degree phase shift between them, as shown in FIG. 1.

Compact CP antennas, such as those commonly used in GPS receivers, are made electrically small by using very high dielectric constant substrates, such as ceramics, to the detriment of bandwidth.

Other size reduction techniques include $\lambda_G/4$ patches with short circuit loading on one edge. Further size reduction can also be achieved by using short circuited folded patches and other variants of that kind. While those antennas can perform well as linearly polarized antennas, the use of shorting pins violates the orthogonal symmetry required for a CP operation. Examples of patch configurations using short circuit loading are shown in FIG. 2.

A slotted patch, a variation often used to create multi-band antennas, however, is amenable to circularly polarized operation because of its orthogonal symmetry. Multiple resonant modes may be created by the addition of the slots, but the lowest order (lowest frequency) resonant mode occurs at a frequency lower than a solid conductor patch of equivalent size. Equivalently, for a given frequency of operation, the slotted patch would be smaller. That configuration is illustrated in FIG. 3.

The aforementioned can be explained by considering the basic components of the patch antenna model of FIG. 1. Radiating edges still exist and are separated and fed by a 180-degree resonator (resonant conductive patch). By introducing slots in the patch, the electrical path taken by the lowest order mode is longer than it would be for a patch without slots. Hence, the 180-degree resonator can be made physically smaller.

A logical extension that could be made by someone skilled in the art could be to cut more slots in the patch, thereby further reducing the physical size of the resonant conductive patch. That idea is limited as there is a point when no more slots can be added that are sufficiently sized to further reduce the physical size of the 180° resonator. Thus, an unaddressed need exists in the art to address the aforementioned deficiencies and inadequacies for circularly polarized patch antennas.

SUMMARY OF THE INVENTION

Embodiments of the present invention provide an apparatus and method for providing a circularly polarized patch antenna that enables further size reduction without a deterioration in the function of the antenna. Briefly described, a preferred embodiment of the invention can be implemented as follows. In the preferred embodiment, a multi-layer resonator is separated from a conductive ground plane with a dielectric substrate. Slots spanning two layers are formed by perimeters that meander from the top conductive layer of the resonator to the middle conductive layer of the resonator. Meandering between layers is accomplished by a plurality of plated holes outside the plane of the patch antenna which electrically interconnects the layers of the resonator. The combination of the slots and meandering between layers lengthens the electrical path taken by the lowest order mode, thereby further reducing physical size of the 180° resonator. Beyond increased electrical path length, resonator size reduction is also achieved by the effective dielectric constant of the middle layer, which is higher than the top layer due to the fact that it is embedded in the dielectric substrate material.

Embodiments of the present invention can also be viewed as providing methods for designing a circularly polarized slotted patch antenna as described above.

FIGS. 4B and 4C, illustrate the designs of a slotted patch and a conventional patch antenna, respectively, as compared to the preferred embodiment illustrated in FIG. 4A.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 1 is a drawing illustrating a resonant conductive patch of a patch antenna;

FIGS. 2A and 2B are drawings illustrating antennas with a short circuit patch and folded short circuit patch, respectively;

FIG. 3 is a drawing illustrating a comparison of the electrical path for a basic patch and a slotted patch antenna configuration;

DETAILED DESCRIPTION OF THE PREFERRED EMBODIMENT

Figure 4A:
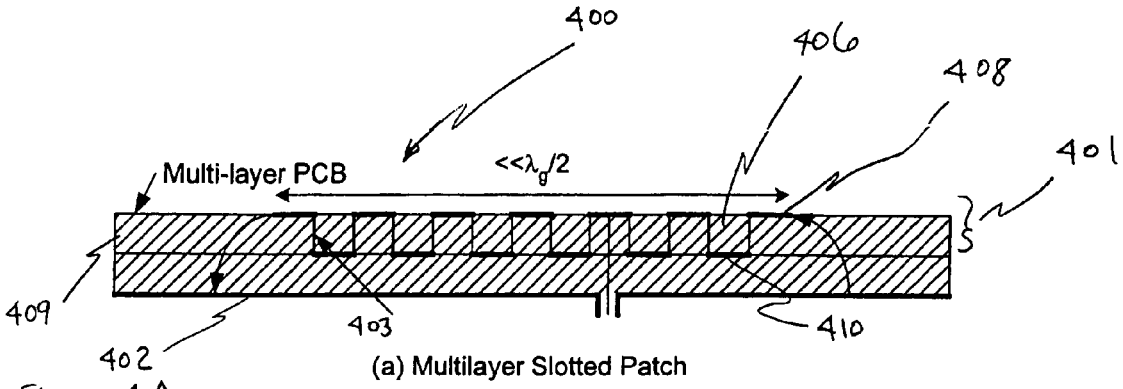
FIG. 4A is a cross-section drawing of the multi-layer slotted patch antenna of the preferred embodiment of the invention.
Figure 4B:
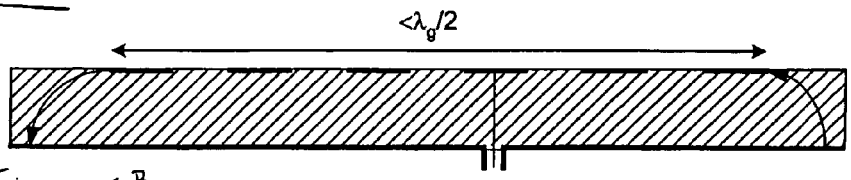
FIG. 4B is a cross-section drawing of a prior art slotted patch antenna.
Figure 4C:
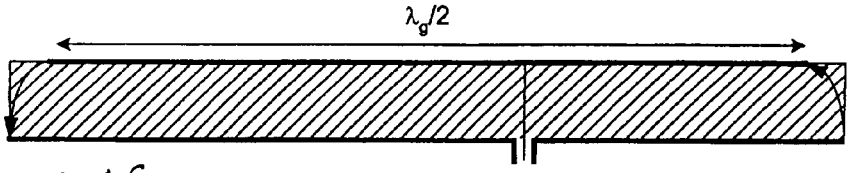
FIG. 4C is a cross-section drawing of a prior art patch antenna.

As illustrated in FIG. 4A, the preferred embodiment includes a patch antenna 400 with slots 406. Plated holes 403 may be added as additional meandering outside a plane of the patch antenna 400.

In the preferred embodiment, a conductive ground plane 402 and a multi-layer resonator 401 are disposed in a substrate 409, parallel to each other. The resonator 401 may be comprised of a top conductive layer 408 in parallel with a middle conductive layer 410. Plated holes 403 electrically connect the top 408 and middle 410 conductive layers. A plurality of slots 406 (e.g. slots 1–9 in FIG. 5) may be intermittently disposed spanning the top 408 and middle 410 conductive layers. The plurality of slots 406 may be integrated with the plated holes 403 that interconnect the top 408 and middle 410 conductive layers. Using the aforementioned structural arrangement, physical length of the resonator 401 may be much less than $\lambda g/2$, wherein $\lambda g$ is the guided wavelength.

Figure 5:
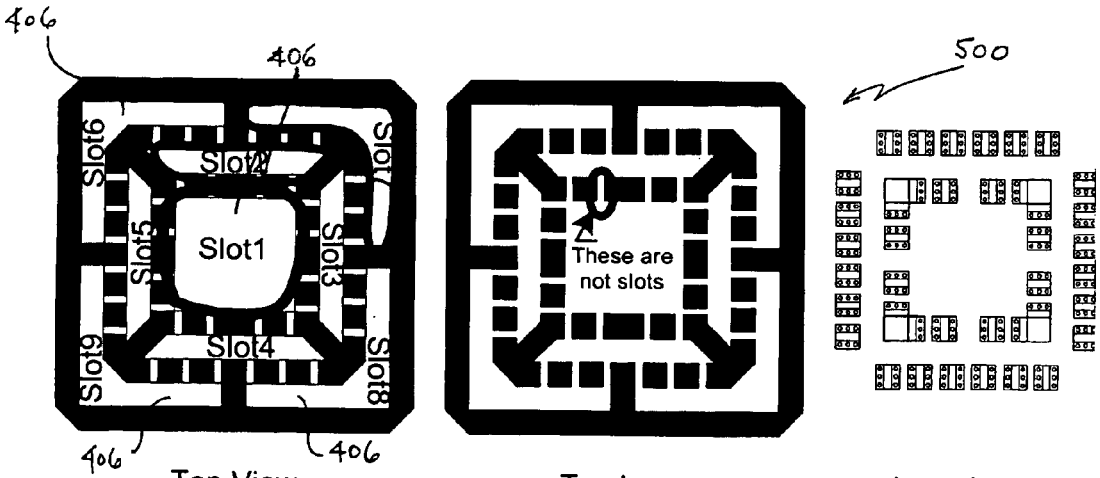
FIG. 5 is a plan view of the multi-layer slotted patch antenna and its layers.

In the present patch antenna, the reduction of the resonator 401 is enabled by lengthening the electrical path beyond what is normally available in the plane of the antenna. The plan view of the aforementioned compact design is shown in FIG. 5 with the top conductive layer 408, the slots 406 (slots 1–9), and the middle conductive layer 410. One can recognize in FIG. 5 the dispersion of the slots 406 throughout the resonator 401. By going outside of the plane of the top layer, the overall design makes more efficient use of the occupied volume than that available in the prior art.

Wireless systems most often require antennas with wide antenna bandwidths. Because of the volume-bandwidth relationship in antennas, an increase in patch bandwidth generally requires increased substrate thickness. Because the resonant conductive patch still requires roughly the same dimensions independent of substrate thickness, unlike the present antenna, prior art patch antennas do not have a significant reduction in footprint as they increase in thickness. The additional volume under the center portion of the patch antenna does not contribute to the antenna bandwidth to the same degree as the edge of the patch, because the edges are the primary radiators. The present patch antenna takes advantage of the increased thickness to allow longer meandering between the top and middle layers, thereby lengthening the electrical path and enabling further size reduction. Unlike other size reduction techniques, the present patch antenna includes the required symmetry to allow for circularly polarized operation.

It should be emphasized that the above-described embodiments of the present invention, particularly any preferred embodiments, are merely possible examples of implementations, merely set forth for a clear understanding of the principles of the invention. Many variations and modifications may be made to the above-described embodiments of the invention without departing substantially from the sprit and principles of the invention. All such modifications and variations are intended to be included herein within the scope of this disclosure and the present invention and protected by the following claims.

What is claimed is:

1. A patch antenna suitable for transmitting and receiving electromagnetic signals, comprising:

a conductive ground plane;

a resonator positioned on top of said conductive ground plane, wherein said resonator includes:

a top conductive layer, a middle conductive layer, a plurality of slots spanning said top and middle conductive layers, and conductive meandering along a perimeter of the plurality of slots connecting said top and middle conductive layers; and a dielectric substrate separating said conductive ground plane and said resonator.

2. The patch antenna according to claim 1, wherein outer dimensions of said resonator are less than $\lambda g/2$.

3. The patch antenna according to claim 2, wherein said slots are spaced in a regular pattern along said resonator.

4. The patch antenna according to claim 1, wherein said conductive ground plane and said resonator are realized in a multi-layer printed circuit board.

5. The patch antenna according to claim 1, wherein said meandering includes plated holes that interconnect said top and middle conductive layers.

6. The patch antenna according to claim 1, wherein the patch antenna includes symmetry that facilitates circularly polarized operation.

7. A circularly polarized patch antenna, comprising:

a conductive ground plane;

top and bottom conductive layers disposed in a dielectric substrate and positioned in parallel with the conductive ground plane; and plated holes integrated with the plurality of slots and electrically joining the top and bottom conductive layers.

8. A method for providing a patch antenna, said method comprising the steps of:

providing a conductive ground plane;

providing a multi-layer resonator parallel to said conductive ground plane, wherein conductive meandering electrically interconnects the multi-layer resonator around a perimeter of a plurality of slots within the resonator that integrates with the meandering; and separating the resonator and the conductive ground plane with a dielectric substrate.

9. The method according to claim 8, comprising the step of forming top and middle conductive layers comprising the multi-layer resonator.

10. The method according to claim 8, comprising the step of forming a multi-layer printed circuit board using the conductive ground plane, the top and middle conductive layers with associated meandering, and the plurality of slots.

11. The method according to claim 10, comprising the step of forming the meandering as plated holes.

12. The method according to claim 8, further comprising forming a circularly polarized patch antenna wherein outer dimensions of the resonator are less than $\lambda g/2$.

13. A method for providing a circularly polarized patch antenna, said method comprising the steps of:

providing a conductive ground plane;

providing a resonator with top and middle conductive layers;

adding plated holes outside a plane of the patch antenna for electrically connecting the top and middle conductive layers;

interposing a plurality of slots spanning the top and middle conductive layers; and disposing a dielectric substrate between the top and middle conductive layers and the conductive ground plane.

* * * * *